US009496649B2

(12) United States Patent
Burns et al.

(10) Patent No.: US 9,496,649 B2
(45) Date of Patent: Nov. 15, 2016

(54) CYLINDRICAL MOUNTED BREAK-AWAY INTERCONNECT

(71) Applicant: ITT MANUFACTURING ENTERPRISES, LLC, Wilmington (DE)

(72) Inventors: Cameron Burns, Foothill Ranch, CA (US); Michael Finona, Garden Grove, CA (US)

(73) Assignee: ITT Manufacturing Enterprises, LLC, Wilmington, DE (US)

( * ) Notice: Subject to any disclaimer, the term of this patent is extended or adjusted under 35 U.S.C. 154(b) by 0 days.

(21) Appl. No.: 14/510,824

(22) Filed: Oct. 9, 2014

(65) Prior Publication Data

US 2016/0104970 A1 Apr. 14, 2016

(51) Int. Cl.

| | |
|---|---|
| ***H01R 13/533*** | (2006.01) |
| ***H01R 31/06*** | (2006.01) |
| ***H01R 13/516*** | (2006.01) |
| ***H01R 13/187*** | (2006.01) |
| ***H01R 13/622*** | (2006.01) |
| ***H01R 13/64*** | (2006.01) |
| ***E21B 17/02*** | (2006.01) |

(Continued)

(52) U.S. Cl.

CPC ..... *H01R 13/64* (2013.01); *E21B 17/028* (2013.01); *H01R 13/6277* (2013.01); *H01R 13/6456* (2013.01); *H01R 31/06* (2013.01); *H01R 13/533* (2013.01)

(58) Field of Classification Search

CPC ..... Y10S 439/901; Y10S 439/955; H01R 13/5202; H01R 13/187; H01R 13/516; H01R 13/5219; H01R 13/622; H01R 13/533; H01R 31/06; Y10T 29/49174; Y10T 29/49195

USPC ..... 439/680, 180, 628, 638, 649, 656, 660, 439/677, 915, 906

See application file for complete search history.

(56) References Cited

U.S. PATENT DOCUMENTS 3,659,251 A * 4/1972 Fish ..... H01R 13/516 174/87
3,999,830 A * 12/1976 Herrmann, Jr. ..... H01R 13/518 439/204

(Continued)

FOREIGN PATENT DOCUMENTS

| | | |
|---|---|---|
| EP | 1237233 A1 | 9/2002 |
| EP | 1530269 A2 | 5/2005 |
| EP | 1900067 B1 | 3/2008 |

OTHER PUBLICATIONS

Partial Search Report in corresponding European Patent Application No. 15189203.1, dated Mar. 11, 2016, in 8 pages.

*Primary Examiner* — Amy Cohen Johnson
*Assistant Examiner* — Matthew T Dzierzynski
(74) *Attorney, Agent, or Firm* — Knobbe, Martens, Olson & Bear LLP

(57) ABSTRACT

An electrical-connection system for connecting a first cable to a second cable includes a central connector unit that attaches to cable-end connectors. Among other features, the central connector unit might include a curved surface, each of the cable-end connectors might include a grip mechanism. Generally, the electrical-connection system is configured to be positioned in a radial groove of a cylindrical body, such that an overall height of the system is maintained within space constraints.

21 Claims, 6 Drawing Sheets

(51) Int. Cl.
*H01R 13/645* (2006.01)
*H01R 13/627* (2006.01)

(56) References Cited

U.S. PATENT DOCUMENTS

| | | | | |
|---|---|---|---|---|
| 4,708,663 | A * | 11/1987 | Eckart | H01R 13/5841 439/469 |
| 5,679,026 | A | 10/1997 | Fain et al. | |
| 6,315,617 | B1 | 11/2001 | Al-Sabah | |
| 6,568,949 | B1 * | 5/2003 | Walters | H01R 13/5202 439/319 |
| 6,761,588 | B2 * | 7/2004 | Heebe | H01R 13/633 439/348 |
| 6,899,532 | B2 * | 5/2005 | Eddy | H01R 13/5219 310/71 |
| 7,442,080 | B1 * | 10/2008 | Tsen | H01R 9/0503 439/181 |
| 7,955,145 | B2 * | 6/2011 | Chansrivong | H01R 13/15 439/788 |
| 8,323,058 | B2 * | 12/2012 | Flaherty | H01R 13/6277 439/680 |
| 8,888,527 | B2 * | 11/2014 | Chastain | H01R 24/545 439/578 |
| 9,048,587 | B2 * | 6/2015 | Marsh | H01R 11/12 |
| 2010/0304609 | A1 | 12/2010 | Lee et al. | |

* cited by examiner

CYLINDRICAL MOUNTED BREAK-AWAY INTERCONNECT

BACKGROUND

In downhole-drilling operations an electrical connection typically connects internal drilling components with an external power source. Sometimes space constraints create a relatively narrowly defined region in which the electrical connection is allowed to be positioned.

SUMMARY

The present invention is directed to an electrical-connection system for connecting a first cable to a second cable, the electrical-connection system including a central connector unit that attaches to cable-end connectors. In one embodiment, the central connector unit includes a curved surface. In another embodiment, each of the cable-end connectors includes a grip mechanism. In a further embodiment, the electrical-connection system is configured to be positioned in a radial groove of a cylindrical body, such that an overall height of the system is maintained within space constraints.

Embodiments of the invention are defined by the claims below, not this summary. A high-level overview of various aspects of the invention is provided here to introduce a selection of concepts that are further described in the detailed-description section below. This summary is not intended to identify key features or essential features of the claimed subject matter, nor is this summary intended to be used as an aid in isolation to determine the scope of the claimed subject matter.

BRIEF DESCRIPTION OF THE DRAWINGS

Illustrative embodiments of the present invention are described in detail below with reference to the attached figures, which are incorporated herein by reference, wherein.

DETAILED DESCRIPTION

The subject matter of embodiments of the present invention is described with specificity herein to meet statutory requirements. But the description itself is not intended to necessarily limit the scope of claims. Rather, the claimed subject matter might be embodied in other ways to include different elements or combinations of elements similar to the ones described in this document, in conjunction with other present or future technologies.

At a high level, an embodiment of the present invention is directed to an electrical-connection system for connecting cables in a radial groove of a cylinder. For example, the electrical-connection system includes a central connector unit that attaches to cable-end connectors. The central connector unit and the cable-end connectors are configured with various features that allow the overall height of the electrical-connection system to be maintained within space constraints of the radial groove.

Figure 1:
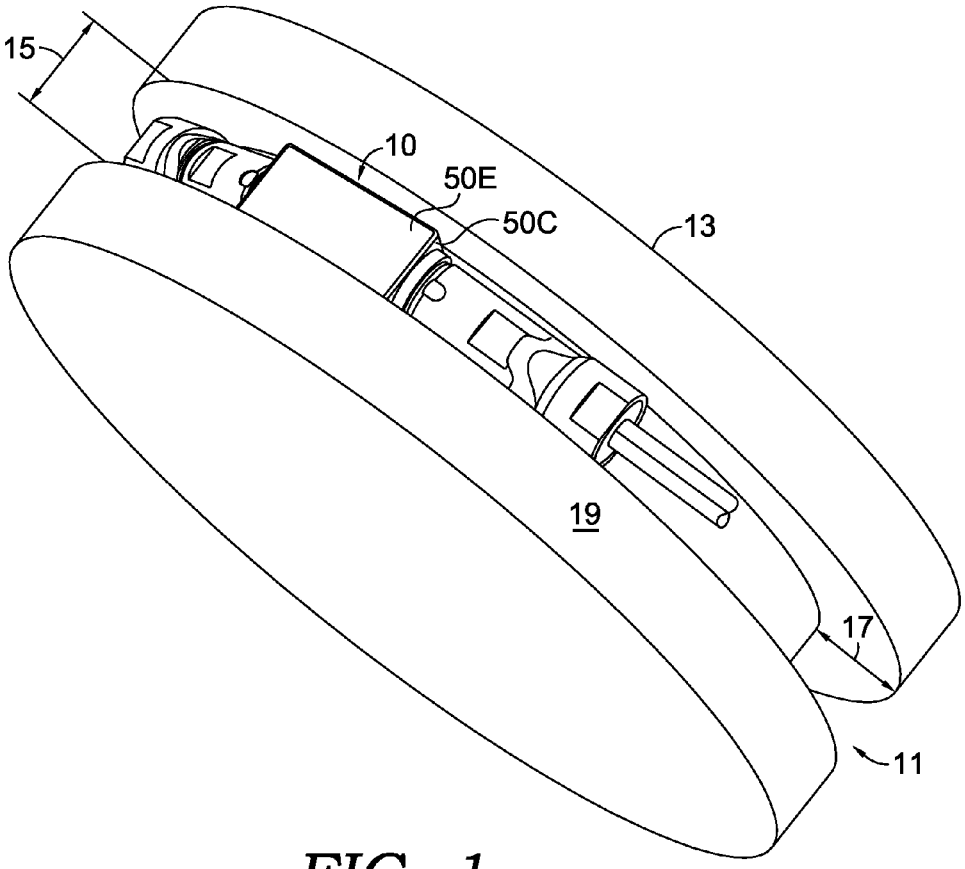
FIG. 1 depicts an electrical-connection system positioned in a radial groove in accordance with an embodiment of the present invention.

Referring now to FIG. 1, an exemplary depiction is provided in which an electrical-connection system 10 is positioned within a radial groove 11 of a cylinder 13. The cylinder 13 is only generically depicted for illustrative purposes, and in some embodiments the cylinder includes a downhole-drilling component positioned inside a casing. The electrical-connection system 10 might provide an electrical connection between one or more drilling components (e.g., inside a casing) and one or more external components (e.g., power source). The groove 11 and the cylinder 13 provide certain space constraints, such as a groove width 15 and a groove depth 17 (see also FIG. 2) defined by the inside diameter and outside diameter. In one embodiment, the electrical-connection system 10 includes features that allow the system 10 to maintain an overall height that does not exceed the space constraints.

Figure 2:
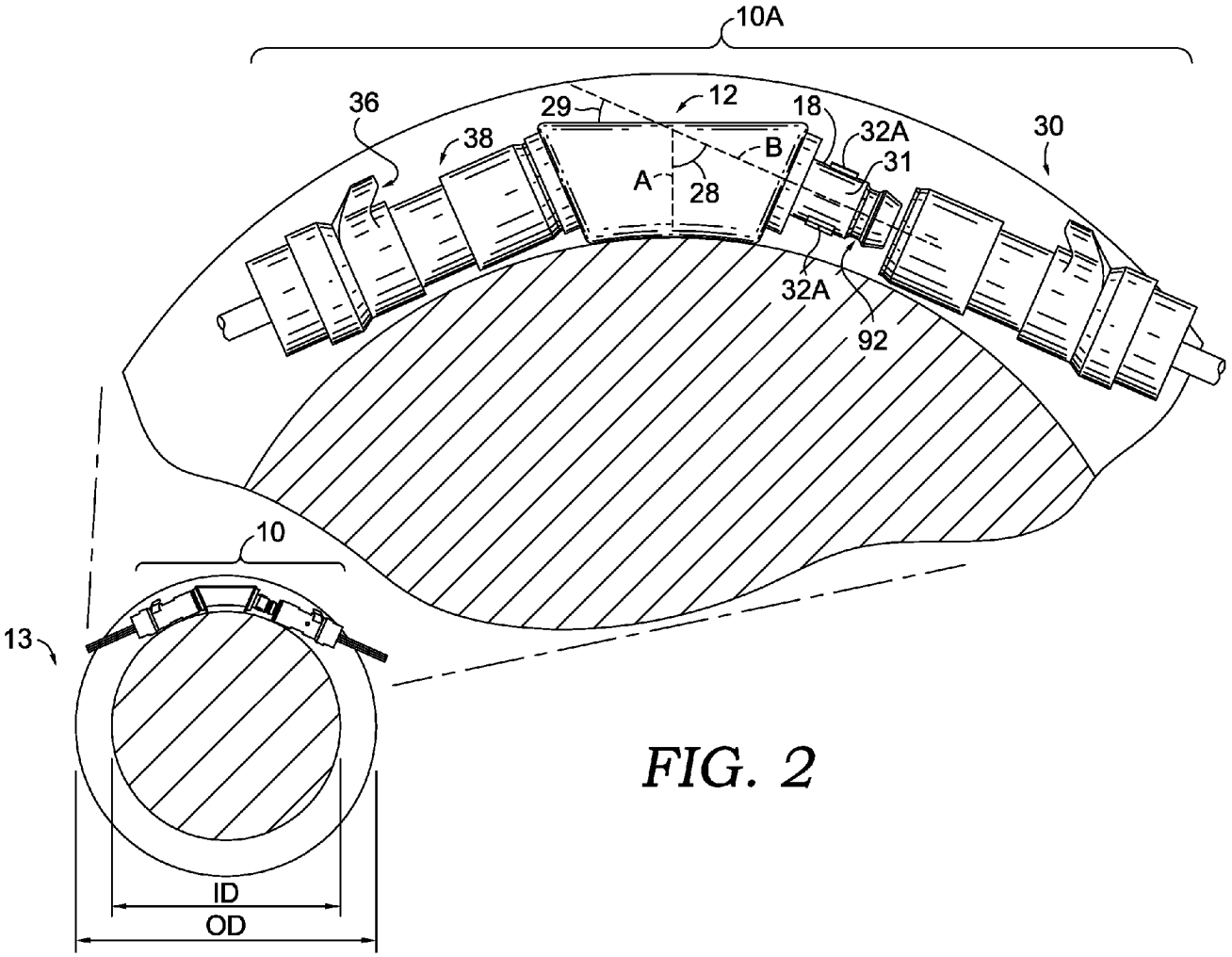
FIG. 2 depicts a partial cross-section of a cylindrical body with an electrical-connection system in accordance with an embodiment of the present invention.

FIG. 2 depicts a cross-section of the cylinder 13 and groove 11, as well as an illustrative view of the electrical-connection system 10 positioned within the groove. In addition, FIG. 2 depicts a blown-up view in which the electrical-connection system 10 is enlarged for illustrative purposes, and the blown-up version of the electrical-connection system is identified by reference numeral 10A.

In FIG. 2, the groove depth is defined by an internal diameter and an external diameter. In an embodiment of the present invention, the elements of the electrical-connection system 10 help to maintain the system 10 within the radial groove and help to reduce the likelihood that the system 10 will exceed the groove and extend out of the groove and beyond an outer surface 19 (FIG. 1.) of the cylinder 13.

Referring to FIGS. 1-4, the system 10 includes a central connector unit 12 that connects to a first cable-end connector 30 and a second cable-end connector 38. As previously mentioned, the first cable-end connector 30 and the second cable-end connector 38 attach to the central connector unit 12 in such a manner that the overall height of the electrical-connection system 10 is maintained within the radial groove 11 when the connectors 30 and 38 are connected to the central connector unit 12 and the system 10 is positioned in the groove 11.

Various features contribute to maintaining a desired height of the system 10, and some of these elements are listed in this portion of the description to provide a context for reading the subsequent portions of the description. But these elements will also be described in more detail in the subsequent portions. In one aspect, an angle 28 at which the connectors 30 and 38 attach to the central connector unit 12 helps maintain a desired height. In FIG. 2, while only the angle 28 is labeled with respect to the connector 30, a similar angle measurement applies to the connector 38. In another embodiment, a polarized connection (e.g., keyed) between the central connector unit 12 and the cable-end connectors 30 and 38 also helps to maintain a desired alignment of connectors, which helps to maintain a certain overall height. A further embodiment includes a curved surface of the system that has an arc radius similar to a radius of the internal diameter of the groove. Other features will become apparent to a reader after and because of reading this description.

In the drawings, the cable-end connectors 30 and 38 are depicted as female connectors that attach onto male connectors of the central connector unit 12. However, in another embodiment, the cable-end connectors 30 and 38 might include a male connector (e.g., plug) that attaches to a female connector (e.g., socket) of the central connector unit.

Figure 4:
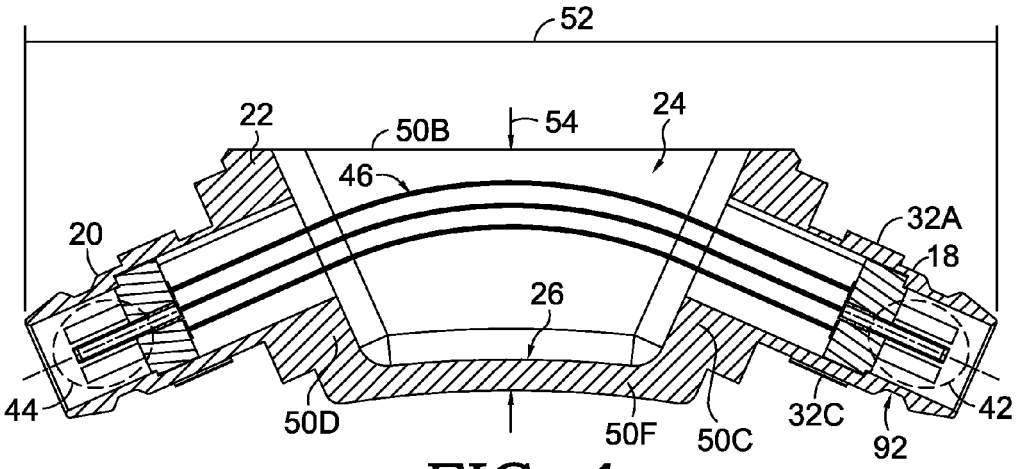
FIG. 4 depicts a cross-sectional view of a central connector unit of an electrical-connection system in accordance with an embodiment of the present invention.

The central connector unit 12 will now be described in more detail. The central connector unit 12 includes a shell 22 (FIG. 4) having a main body 16 and a first joining connector 18 and second joining connector 20 extending from the main body 16. In FIG. 4 the shell is identified by reference numeral 22 and is illustrated as walls (hatched portions) that are connected to one another to make up the central connector unit 12. The main body 16 further comprises a front wall 50A; a back wall 50B (in FIG. 4 the inside surface of the back wall is depicted, and the lead line of numeral 58B references a top edge of the back wall); a right wall 50C; a left wall 50D; a top wall 50E (FIG. 1); and a bottom wall 50F. The terms "top," "bottom," "left," "right," "front," and "back" are relative, are used merely for descriptive purposes with reference to the drawings, and are not meant to unduly limit the claims. In addition, the terms "top" and "bottom" are used to refer to walls that are generally opposed to one another, spaced apart, and generally face each other, and a similar interpretation should be given to the terms "left" and "right," as well as "front" and "back." But, these opposed walls are not necessarily parallel. For example, the right wall 50C and left wall 50D are not illustrated to be parallel, but they are still generally opposed, spaced apart, and face one another.

In an embodiment, the first joining connector 18 mirrors the second joining connector 20. As such, for readability, sometimes only the first joining connector 18 or only the second joining connector 20 might be described, but it should be understood that the same description applies to the other (i.e., non-described) connector.

Figure 3:
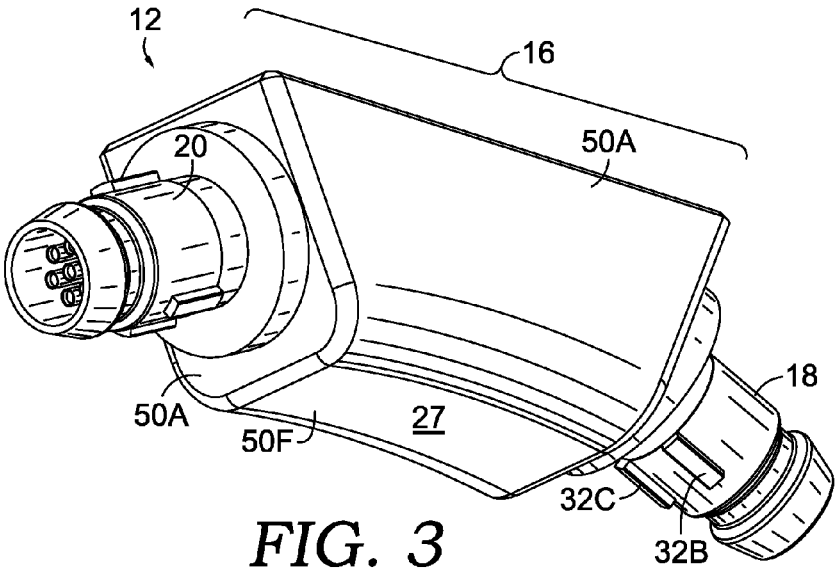
FIG. 3 depicts a central connector unit of an electrical-connection system in accordance with an embodiment of the present invention.

In FIGS. 3 and 4, the main body 16 includes a cavity 24, which is at least partially defined by the front wall 50A, the back wall 50B, the right wall 50C, the left wall 50D, the top wall 50E (FIG. 1), and the bottom wall 50F. The cavity 24 might be filled with an epoxy or other medium.

In a further embodiment, the first joining connector 18 and the second joining connector 20 extend from the main body 16 at an angle 28, which is depicted in FIG. 2. The angle 28 is defined by reference lines A and B. Reference line A extends generally perpendicular to a top wall 32 of the central connector unit 12 and bisects the central connector into a front half and a back half. Reference line B is axially aligned with the joining connector 18, and the angle 28 is defined by the intersection of reference line A and B.

The angle 28 at which the joining connectors 18 and 20 extend from the main body 16 helps to control an angle at which the cable-end connectors 30 and 38 attach to the central connector unit 12. Although the angle 28 is defined by reference lines A and B, other angles might also help define features of the central connector. For example, another angle 29 between reference line B and a line extending parallel to the top wall 50E might also help define the central connector. Reference line A and a line extending parallel to the top wall 50E form a 90 degree angle.

In FIG. 3, the bottom wall 50F includes an external curved surface 27 (FIG. 3). The cross-section view in FIG. 4 also depicts the curved nature of the external surface of the bottom wall 50F. As depicted, the external curved surface 27 includes a generally concave configuration. In one embodiment, an arc radius of the external curved surface 27 substantially corresponds to a radius of the inner diameter of the cylinder 13. As such, the external curved surface 27 is allowed to rest substantially flush against a base of the groove 11.

In one embodiment, the angle 28 and arc radius of surface 57 is determined in-part based on the dimensions of the cylinder 13 and the groove 11. For example, in one context the OD of the cylinder is about 5.750 inches, and the ID of the cylinder is about 4.375 inches, such that the angle 28 is about 66 degrees and the arc radius is about 2.1875 inches. In such an example, the first joining connector and the second joining connector would be angled at about 132 degrees with respect to one another. However, the dimensions of the cylinder might be smaller or larger, depending on the context, and the dimensions of the connector system can change accordingly. For example, if the ID is variable and the OD is constant, then angle 28 and arc radius of surface 57 can decrease accordingly.

Figure 5:
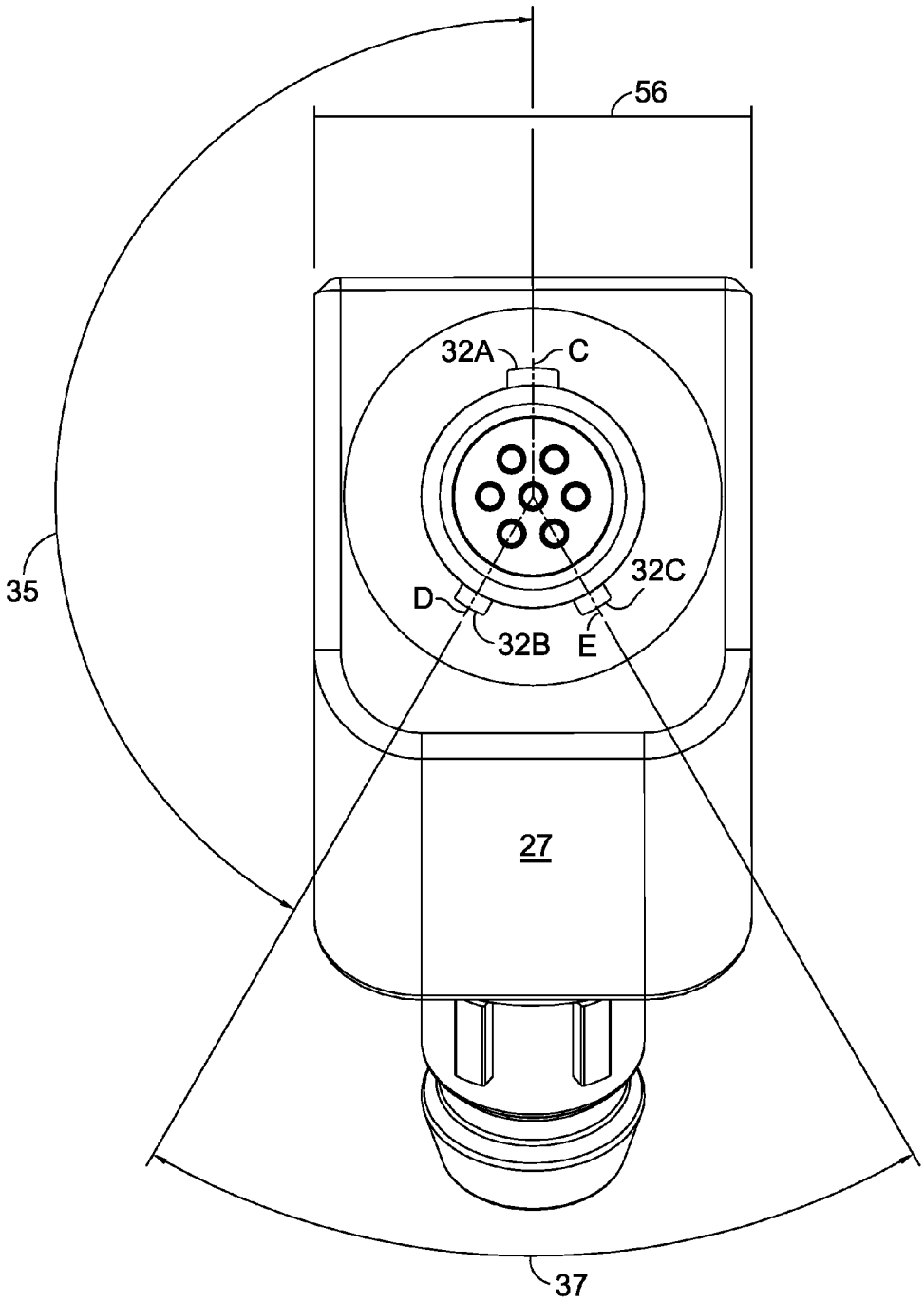
FIG. 5 depicts another view of a central connector unit in accordance with an embodiment of the present invention.

In another embodiment, the central connector unit 12 includes a pin assembly, which includes a first set of one or more pins 42 and a second set of one or more pins 44. The pin assembly includes one or more electrical conductors 46 that electrically couple the pins in the first joining connector 18 to the pins in the second joining connector 20. In one embodiment, the pin assembly includes a 7-pin connector, as illustrated in FIG. 5. In other embodiments, a variety of different pin-assembly configurations might be utilized.

Various steps might be carried out when assembling the pin assembly and installing the pin assembly within the shell 22. For example, the contacts might be tacked into place in the insulator with an appropriate epoxy prior to installation in the shell 22. When the assembly is installed in the shell, the insulator might be tacked into the shell with an epoxy. In addition, as previously described, the cavity of the shell might also be filled with an appropriate epoxy. Other mechanism might also be used to couple the various components, such as mechanical fasteners.

As previously described, the first cable-end connector 30 attaches to a first joining connector 18. In one embodiment, an interface between the cable-end connector 30 and the joining connector 18 includes a first set of one or more keys that aligns with a first set of one or more keyways. For example, the first joining connector 18 includes an outer surface 31, and a first set of one or more keys 32A-C radially extend from the outer surface 31. In addition, the cable-end connector 30 includes a generally tubular body having an inner surface 33, which includes a first set of one or more keyways 34A-C (see FIG. 6) that mates with the first set of one or more keys 32A-C.

Among other things, the mating relationship between the keys and keyways helps to prevent the components of the electrical-connection system 10 from rotating relative to one another when connected and helps to properly align the components. For instance, the keys might be unevenly spaced with respect to one another in a manner that corresponds with the keyways, such that only one orientation of the cable-end connector couples to the central connector unit. An exemplary spacing is depicted in FIG. 5 in which keys 32B and 32C are closer together to one another than to the other key 32A. That is, reference lines C, D, and E represent a general axial relationship between keys 32A, 32B, And 32C, and lines C and D intersect at an angle 35 that is larger than an angle 37 between lines D and E. As such, a corresponding keyway configuration can only mate with the keys when the keyways are oriented in a similar manners (i.e., the upper keyway is spaced further apart from the two lower keyways than the two lower keyways are to each other).

Although the drawings depict keys on the joining connector 18 and 20 and keyways in the cable-end connector, in an alternative embodiment the keys might extend inward from the inside surface of the cable-end connector and the joining connector might include the corresponding keyways. In addition, although the drawings depict three keys and three keyways, as few as one key and one keyway or more than three keys and keyways might be employed.

Other features of the central connector unit 12 might also contribute to maintaining the connection within space constraints of the groove 11. For example, the central connector unit 12 might include a ratio of dimensions that help to maintain the system 10 within certain space constraints. As such the main body 16 might include a height 54 (FIG. 4) from the bottom wall 50F to the top wall 50E, a length 52 (FIG. 4) from an end of one joining connector 18 to an end of the other joining connector 20, and a width 56 (FIG. 5). In one embodiment, a ratio of two or more of these dimension relative to one another help to maintain the system 10 within the space constraints of a groove. For example, in one embodiment, the central connector unit 12 includes a height to length ratio of about 0.49:1.96. In another embodiment, the central connector unit 12 includes a height to width to length ratio of about 0.49:0.51:1.96. In another embodiment, these ratios can be extrapolated to be applied to grooves having various groove sizes.

Figure 6:
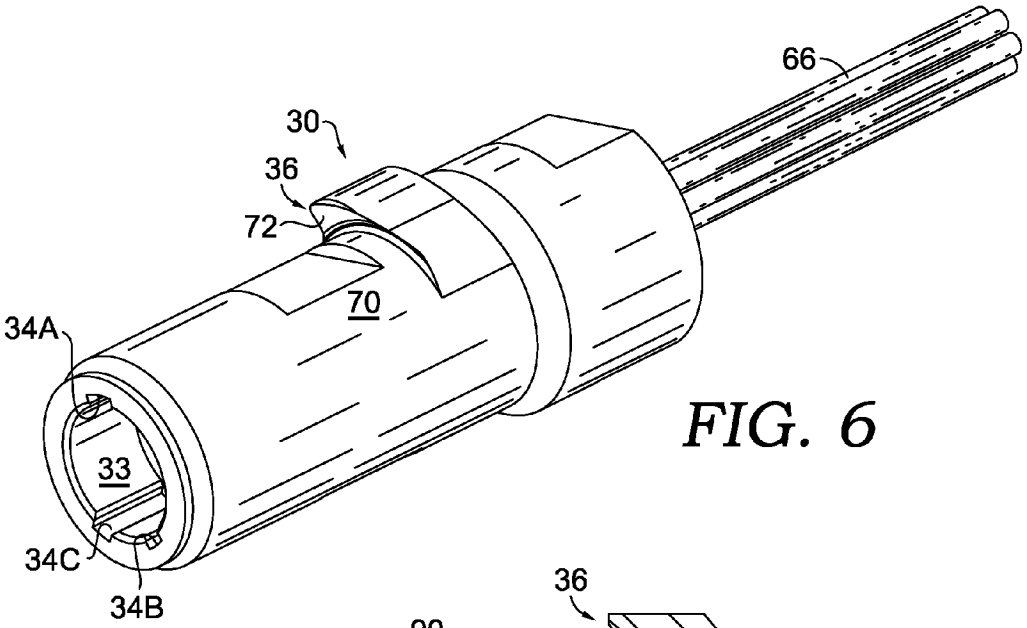
FIG. 6 depicts a cable-end connector of an electrical-connection system in accordance with an embodiment of the present invention.
Figure 7:
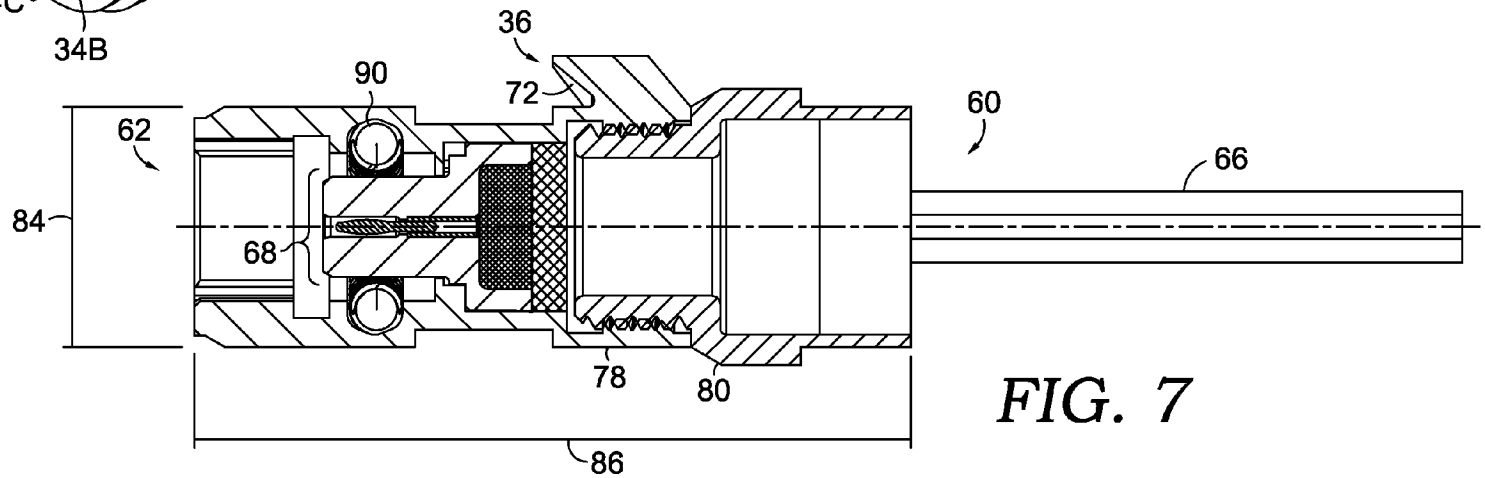
FIG. 7 depicts a cross-sectional view of a cable-end connector of an electrical-connection system in accordance with an embodiment of the present invention.
Figure 8:
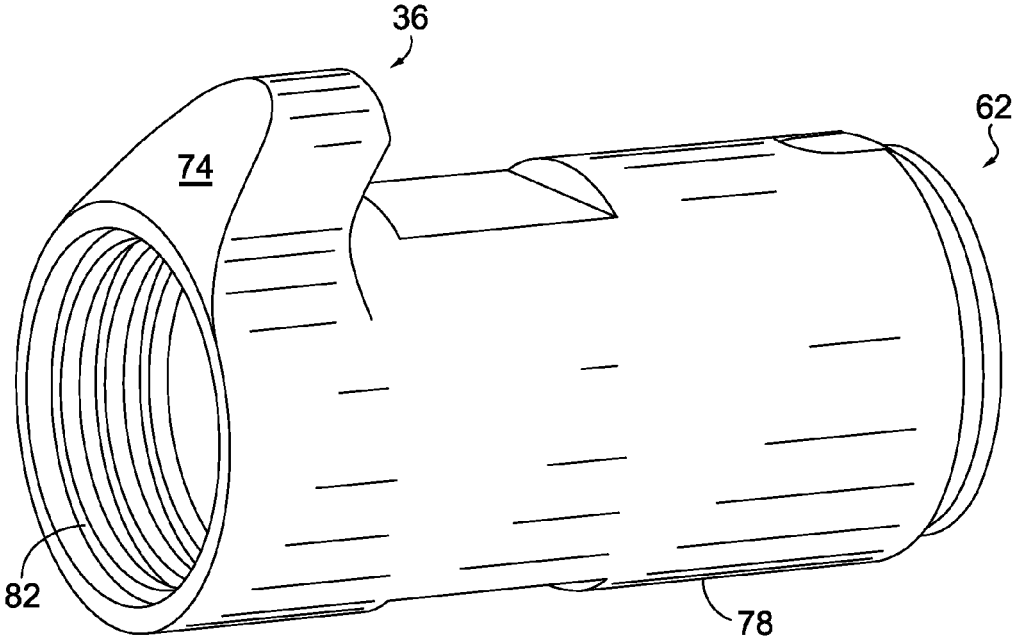
FIG. 8 depicts a portion of a cable-end connector of an electrical-connection system in accordance with an embodiment of the present invention.

Referring now to FIGS. 6-8, the cable-end connector 30 will be described in more detail. The cable-end connector 30 includes a cable-insertion end 60 and a connector-attachment end 62. Generally, a cable 66 can be inserted into the cable-insertion end 60 and coupled to a pin assembly 68, which is proximate to the connector-attachment end 62. The pin assembly 68 mates with the set of one or more pins 42 of the central connector unit 12 when the connector-attachment end 62 is coupled to the joining connector 18. As such, the cable-end connector 30 functions to couple the cable 66 to the central connector unit. When a plurality of cables are coupled to the central connector unit (by way of respective cable-connection ends), the central connector unit provides an electrical connection between the plurality of cables.

The cable-end connector 30 includes various features that assist with connecting or disconnecting within a cylindrical groove. For example, the cable-end connector 30 includes a radially extending gripping mechanism 36. The radially extending gripping mechanism includes a protruding member that extends outward from a surface 70 of the cable-end connector. As depicted in FIGS. 6-8, the radially extending gripping mechanism 36 includes a first surface 72 that faces towards the connector-attachment end 62 and that includes a generally concave configuration. In addition, the radially extending gripping mechanism 36 includes a second surface 74 (FIG. 8) that faces towards the cable-insertion end 60 and that includes a generally convex configuration. The orientation and curvature of the surfaces 72 and 74 helps to improve the ability of a user to grip the cable-end connection when connecting and disconnecting.

In a further embodiment, features of the system 10 help to maintain the gripping mechanism 36 within a groove 11. For example, as previously described, the key and keyway interface is polarized and facilitates proper alignment in order for the cable-end connector 30 to couple with the joining connector 18. As such, when properly aligned, the gripping mechanism 36 extends towards an opening of the groove, as opposed to interfering with side walls of the groove. In addition, the key and keyway help to impede the cable-end connector 30 from rotating relative to the joining connector 18, since rotation could cause the gripping mechanism 36 to interfere with the groove walls.

In addition, dimensions of the gripping mechanism 36 also help to maintain an overall height of the system 10 within the space constraints of the groove 11. For example, in one embodiment, the gripping mechanism includes a height of about 0.093 inches. As such, the height of the gripping mechanism helps to limit portions of the system 10 extending beyond a groove when the system 10 is positioned within the groove.

As depicted in FIGS. 7 and 8, the cable-end connector 30 includes a first shell 78 and a second shell 80. In addition, the first shell 78 and second shell 80 are mechanically coupled, such as via threads. For instance, internal threads 82 of the first shell 78 are depicted in FIG. 8. However, other mechanical fasteners might also be utilized to connect the first shell to the second shell. In an alternative embodiment, the shells 78 and 80 might be coupled by some other mechanisms, such as by an adhesive, weld, or other mechanism. In another embodiment, the shells 78 and 80 are combined into a single shell, such as by casting.

The cable-end connector 30 includes an overall length 86 from the cable-insertion end 60 to the connector-attachment end 62. In one embodiment, the length 82 is configured to help keep the system 10 within certain space constraints created by the groove 11. For example, in one instance, the length 82 helps to keep both cable-insertion ends 60 from extending beyond the outer diameter of the cylinder. In one embodiment, the length is about 1.303 inches.

The cable-end connector 30 also includes a diameter 84. In one embodiment, the diameter 84 is configured to help keep the system 10 within certain depth 17 and width 15 constraints created by the groove 11. In one embodiment, the diameter is about 0.435 inches.

The cable 66 and pin assembly 68 might be secured within the cable-end connector 30 using various elements. For example, similar to the joining connectors, the insulator potting well might be filled with an epoxy prior to installation in the connector-attachment end 62 in order to hold the contacts in place. In addition, a canted spring 90 or other retaining mechanism might also be installed within the connector-attachment end prior to installing the insulator. The canted spring 90 or other retainer engages a lip or groove 92 in the outer surface 31 of the joining connector 18. Once the insulator and contacts are installed, the shells 78 and 80 might be at least partially filled with one or more types of epoxy. For example, the shell 78 might be filled with a first type of epoxy, which is filled up to an interface with the shell 80, which might be filled with a second type of epoxy.

Many different arrangements of the various components depicted, as well as components not shown, are possible without departing from the scope of the claims below. Embodiments of our technology have been described with the intent to be illustrative rather than restrictive. Alternative embodiments will become apparent to readers of this disclosure after and because of reading it. Alternative means of implementing the aforementioned can be completed without departing from the scope of the claims below. Certain features and subcombinations are of utility and may be employed without reference to other features and subcombinations and are contemplated within the scope of the claims.

The invention claimed is:

1. An electrical-connection system for connecting a first downhole cable to a second downhole cable, the system configured to be received in a groove of a downhole cylindrical component, the groove having a curved bottom and a radial depth, the system comprising:

a central connector unit including a shell having a main body and a first connector and a second connector extending from the main body, wherein the main body includes a cavity, a radially-outwardly directed exterior surface facing away from the cavity, and a radially-inwardly directed exterior curved surface facing away from the cavity, wherein, when the central connector unit is received in the groove, the radially-inwardly directed exterior curved surface abuts against the curved bottom of the groove, and wherein the first connector and the second connector extend from the main body at an angle respective to one another;

a first cable-end connector that mates with the first connector, wherein a first interface between the first connector and the first cable-end connector includes a first set of one or more keys that aligns with a first set of one or more keyways; and wherein the first cable-end connector includes a first radially extending gripping mechanism; and a second cable-end connector that mates with the second connector, wherein a second interface between the second connector and the second cable-end connector includes a second set of one or more keys that aligns with a second set of one or more keyways; and wherein the second cable-end connector includes a second radially extending gripping mechanism; and wherein, when the central connector unit is positioned in the groove with the radially-inwardly directed exterior curved surface abutted against the curved bottom of the groove, and the first connector is connected with the first cable-end connector, and the second connector is connected with the second cable-end connector, the overall radial height of the electrical-connection system is less than the radial depth of the groove.

2. The electrical-connection of claim 1, wherein the central connector unit further comprises a pin assembly that extends through the cavity of the shell from the first connector to the second connector and that provides an electrical connection between the first connector and the second connector.

3. The electrical-connection of claim 1, wherein the first connector further comprises an outer surface, which includes the first set of one or more keys radially extending from the outer surface.

4. The electrical-connection of claim 3, wherein the outer surface includes a radial retaining groove for coupling with a fastener of the first cable-end connector.

5. The electrical-connection of claim 4, wherein the first cable-end connector includes a substantially tubular body having an inner surface, and wherein a canted spring is fitted in within a recess of the inner surface, the canted spring engaging the radial retaining groove.

6. The electrical-connection of claim 3, wherein the first cable-end connector includes a substantially tubular body having an inner surface, which includes the first set of one or more keyways that are spaced to align with the first set of one or more keys when the first cable-end connector is mated with the first connector.

7. The electrical-connection of claim 1, wherein the first cable-end connector includes a first end that attaches to the first connector and a second end for receiving the first cable, wherein the first radially extending gripping mechanism includes a first surface that faces toward the first end and that is generally concave.

8. The electrical-connection of claim 7, wherein the first radially extending gripping mechanism includes a second surface that faces toward the second end and that is generally convex.

9. The electrical-connection system of claim 1:

wherein the main body includes a top wall, a bottom wall, a front wall, a back wall, a left wall, and a right wall;

wherein the bottom wall includes the exterior curved surface, which is generally concave; and wherein the first connector extends from the right wall and the second connector extends from the left wall.

10. An electrical connector for coupling a first cable terminal to a second cable terminal and being configured for installation in the radial groove of a downhole component, the radial groove having a base with a radius, the electrical connector comprising:

a shell that encases a cavity and that includes:

a main body having:

a bottom wall, a top wall, and side walls extending between the bottom wall and the top wall, wherein the bottom wall includes an exterior curved surface outside the cavity that includes an arc extending from a first side wall to a second side wall, the arc comprising an arc radius, the arc radius being about equal to the radius of the base of the groove such that substantially the entirety of the exterior curved surface is configured to rest substantially flush against the base of the groove, a first connector extending from the first side wall of the main body at a first angle, the first angle measured between a reference line A that bisects the main body and a reference line B1 that is coaxial with the first connector, and a second connector extending from the second side wall of the main body at a second angle, the second angle measured between the reference line A and a reference line B2 that is coaxial with the second connector, wherein the first and second angles are acute angles, and wherein the first connector and the second connector extend from the main body at an obtuse angle with respect to one another.

11. The electrical connector of claim 10 further comprising, a pin assembly housed in the cavity, the pin assembly including:

a first set of one or more pins positioned in the first connector a second set of one or more pins positioned in the second connector, and a conductor connecting the first set of one or more pins to the second set of one or more pins and extending through the cavity.

12. The electrical connector of claim 10, wherein the first connector includes a first set of one or more radially extending key projections and the second connector includes a second set of one or more radially extending key projections.

13. The electrical connector of claim 10, wherein the first connector and the second connector each includes a tubular body having an external circumferentially extending groove.

14. The electrical connector of claim 10, wherein the cavity is filled with an epoxy.

15. A cable-end connector for coupling an end of a cable to another electrical device to form an electrical connection system for installation in a radial groove of a downhole component, the cable-end connector comprising:

a generally tubular shell having:

a cable-insertion end, a connector-attachment end, a radially extending gripping mechanism that projects outward from an exterior surface of the tubular shell, the radially extending gripping mechanism comprising:

a first side that is oriented towards the cable-insertion end, the first side sloping away from the cable-insertion end and comprising a generally convex surface, and a second side that is oriented towards the connector-attachment end, the second side sloping toward the cable-insertion end and comprising a generally concave surface, and an interior surface comprising one or more keyways;

an insulator and micropin contact oriented towards the connector-attachment end; and a ring-shaped retention device that at least partially circumscribes the insulator;

wherein the cable-end connector is configured such that, when the electrical connection system is installed in the radial groove of the downhole component, the gripping mechanism of the cable-end connector is oriented radially outwardly and does not protrude out of the radial groove.

16. The cable-end connector claim 15, wherein the cable-insertion end includes a set of threads for threaded attachment to another shell.

17. The cable-end connector claim 15, wherein the radially extending gripping mechanism includes a first side oriented towards the cable-insertion end and a second side oriented towards the connector-attachment end, wherein the first side slopes away from the cable-insertion end and includes a generally convex curved surface.

18. The cable-end connector claim 17, wherein the second side slopes towards the connector-attachment end and includes a generally concave curved surface.

19. The cable-end connector claim 15, wherein the ring-shaped retention device includes a cantor spring.

20. The cable-end connector claim 15, wherein the generally tubular shell includes an inner surface and wherein the cable-end connector further comprises a set of one or more keyways extending into the inner surface.

21. The electrical-connection of claim 1, wherein the external curved surface comprises a generally continuous and generally constant curve.

* * * * *

UNITED STATES PATENT AND TRADEMARK OFFICE

CERTIFICATE OF CORRECTION

PATENT NO. : 9,496,649 B2
APPLICATION NO. : 14/510824
DATED : November 15, 2016
INVENTOR(S) : Burns et al.

It is certified that error appears in the above-identified patent and that said Letters Patent is hereby corrected as shown below:

In the Claims

In Column 10 at Line 9 (approx.), In Claim 16, after "connector" insert --of--.

In Column 10 at Line 12 (approx.), In Claim 17, after "connector" insert --of--.

In Column 10 at Line 18 (approx.), In Claim 18, after "connector" insert --of--.

In Column 10 at Line 21 (approx.), In Claim 19, after "connector" insert --of--.

In Column 10 at Line 23 (approx.), In Claim 20, after "connector" insert --of--.

Signed and Sealed this
Twenty-eighth Day of March, 2017

Michelle K. Lee

Michelle K. Lee
*Director of the United States Patent and Trademark Office*